United States Patent [19]

Hata

[11] Patent Number: 4,997,108

[45] Date of Patent: Mar. 5, 1991

[54] TAP AND LIQUID DISPENSER USING THE SAME

[76] Inventor: Hideaki Hata, 3-9, Mejiro 5-chome, Toshima-ku, Tokyo-to, Japan

[21] Appl. No.: 374,534

[22] Filed: Jun. 30, 1989

[30] Foreign Application Priority Data

Jul. 4, 1988 [JP] Japan ..... 63-166515
Jun. 1, 1989 [JP] Japan ..... 1-139483

[51] Int. Cl.[5] ..... B65D 35/56

[52] U.S. Cl. ..... 222/105; 222/519; 222/549; 251/351; 137/614.13; 137/614.18

[58] Field of Search ..... 222/94, 105, 499, 522, 222/524, 519, 537, 538, 540, 521, 523, 531, 559, 549; 137/614.18, 614.13; 251/351, 346, 144

[56] References Cited

U.S. PATENT DOCUMENTS

| | | | |
|---|---|---|---|
| 1,629,303 | 5/1927 | Phillips | 251/351 X |
| 1,912,304 | 5/1933 | Phillips | 222/519 X |
| 3,173,579 | 3/1965 | Currie et al. | 222/523 X |
| 3,203,665 | 8/1965 | Grant | 251/351 |
| 3,206,075 | 9/1965 | Scholle | 222/105 |
| 3,471,066 | 10/1969 | Micallef | 222/519 |
| 4,412,634 | 11/1983 | Bennett | 222/519 |
| 4,471,807 | 9/1984 | Lucking et al. | 137/614.18 X |
| 4,475,670 | 10/1984 | Rutter | 222/519 X |
| 4,742,851 | 5/1988 | Lundblade | 222/522 X |
| 4,802,610 | 2/1989 | Cheek et al. | 222/523 X |
| 4,878,604 | 11/1989 | Barriac | 222/519 X |

FOREIGN PATENT DOCUMENTS

| | | | |
|---|---|---|---|
| 31184 | 8/1884 | Fed. Rep. of Germany | 222/519 |
| 1077554 | 3/1960 | Fed. Rep. of Germany | 222/522 |
| 811944 | 4/1937 | France | 251/351 |

*Primary Examiner*—Andres Kashnikow
*Assistant Examiner*—Gregory L. Huson
*Attorney, Agent, or Firm*—Koda and Androlia

[57] ABSTRACT

A tap and liquid dispenser which includes a valve housing including one end having an inlet port formed therethrough for introducing an liquid thereinto, a circumferential wall defining a housing passage axially extending therein to communicate with the inlet port, and an attachment flange mounted to the other end thereof for attachment to the supporting member and a tubular valve member telescopically received into the housing passage for axial movement. The valve member includes one end portion having a first valve aperture formed therein, a circumferential wall having a second valve aperture formed therethrough and defining a valve passage connecting the second valve aperture to the first valve aperture. The tap further includes a dispensing mechanism movably attached to the valve member for dispensing the liquid externally of the valve passage and the dispensing mechanism movable between an opened position for allowing liquid to flow outside through the second valve aperture and a closed position to close the second valve aperture.

11 Claims, 10 Drawing Sheets

TAP AND LIQUID DISPENSER USING THE SAME

BACKGROUND OF THE INVENTION

1. Field of the Invention

The present invention relates to a tap and a liquid dispenser, particularly a liquid dispenser having a liquid containing flexible bag received in a case made, for example, of a paperboard, such as a corrugated board, the bag having the tap connected to the opening thereof.

2. Prior Art

Containers for dispensing a desired amount of an alcoholic drink, a liquid condiment or a cooling drink are usually provided with taps. These taps are devised so that liquid in containers is not oxidized during the dispensing thereof. One of the inventors proposed in Australian Patent No. 446, 218 to Fattori a liquid container with a tap, in which container a closed bag is placed within a carton and has the tap attached to its opening, the tap including two valves. Improvements to the Fattori liquid container were provided by the other inventor in Australian Patents Nos. 571,926 and 510,198 to Scholle.

However, the first two liquid containers with taps have a drawback in that the tap of each container is liable to house bacteria around the spout since it always projects outside through the carton. The last one has a structure that the tap is retracted within the carton when it is not used and it is hence kept clean. This tap is however disadvantageous in that it is hard to small size the carton since the retracted tap restricts the minimum depth of the carton.

Accordingly, it is an object of the present invention to provide a tap and a liquid dispenser with the tap which tap effectively prevents bacteria from growing around its spout.

It is another object of the present invention to provide a tap and a liquid dispenser with the tap, which tap may be stored in the carton with a small length as compared to the length of the prior art tap, thereby providing a compact liquid disPenser.

SUMMARY OF THE INVENTION

In view of these and other objects in view, there is, according to one aspect of the present invention, provided a tap comprising: (a) a valve housing including one end having an inlet port formed therethrough for introducing a liquid thereinto, a circumferential wall defining a housing passage axially extending therein to communicate with the inlet port, and an attachment flange mounted to the other end thereof for attachment to a supporting member; (b) a tubular valve member telescopically received in the housing passage for axial movement, the valve member including one end portion having a first valve aperture formed therethin, a circumferential wall having a second valve aperture formed therethrough and defining a valve passage communicating the second valve aperture to the first valve aperture for entering the liquid from the housing passage and through the first valve aperture thereinto, and a closed other end portion; and (c) dispensing means, movably attached to the valve member, for dispensing the liquid outside from the valve passage, the dispensing means being movable between an opening position to open the second valve aperture for allowing the liquid to flow outside through the second valve aperture and a closed position to close the second valve aperture.

Another aspect of the present invention is directed to a liquid dispenser of the type which includes a carton, a flexible bag, having an aperture and received within the carton with the aperture at a lower portion, the bag containing a predetermined amount of a liquid, and a tap communicated at one end to the aperture of the bag, the tap supported at the other end on the carton for dispensing the liquid outside the carton. The tap comprises: a valve housing including one end having an inlet port formed therethrough for introducing a liquid thereinto, a circumferential wall defining a housing passage axially extending therein to communicate with the inlet port, and an attachment flange mounted to the other end thereof for attachment to the carton; a tubular valve member telescopically received in the housing passage for axial movement, the valve member including one end portion having a first valve aperture formed therein, a circumferential wall having a second valve aperture formed therethrough and defining a valve passage communicating the second valve aperture to the first valve aperture for entering the liquid from the housing passage and through the first valve aperture therein, and a closed other end portion; and dispensing means, movably attached to the valve member, for dispensing the liquid externally from the valve passage, the dispensing means being movable between an opening position to open the second valve aperture for allowing the liquid to flow outside through the second valve aperture and a closed position to close the second valve aperture. The valve housing comprises: a hollow cylindrical housing sleeve, including the inlet port at one end thereof and an outer circumferential face; and a hollow cylindrical housing body having concentrically mounted at one end thereof to the outer circumferential face of the housing sleeve to surround a part of the housing sleeve to define an annular cavity in cooperation with the housing sleeve, the housing body having the other end remote from the one end of the housing sleeve and including an inner circumferential face having at least one helical groove formed therein to extend axially and angularly about the housing passage. The valve member is axially movable between a retracted position to be substantially contained within the valve housing and an extended position to project outwardly of the other end of the valve housing, and wherein the valve member comprises a skirt integrally formed therewith so that the skirt is inserted in the annular cavity when the valve member is in the retracted position, the skirt including an engaging pin engaged within the helical groove. The the attachment flange of the valve housing is mounted to the other end of the housing body for supporting the valve housing on the carton.

DETAILED DESCRIPTION OF THE PREFERRED EMBODIMENTS

Figure 1:
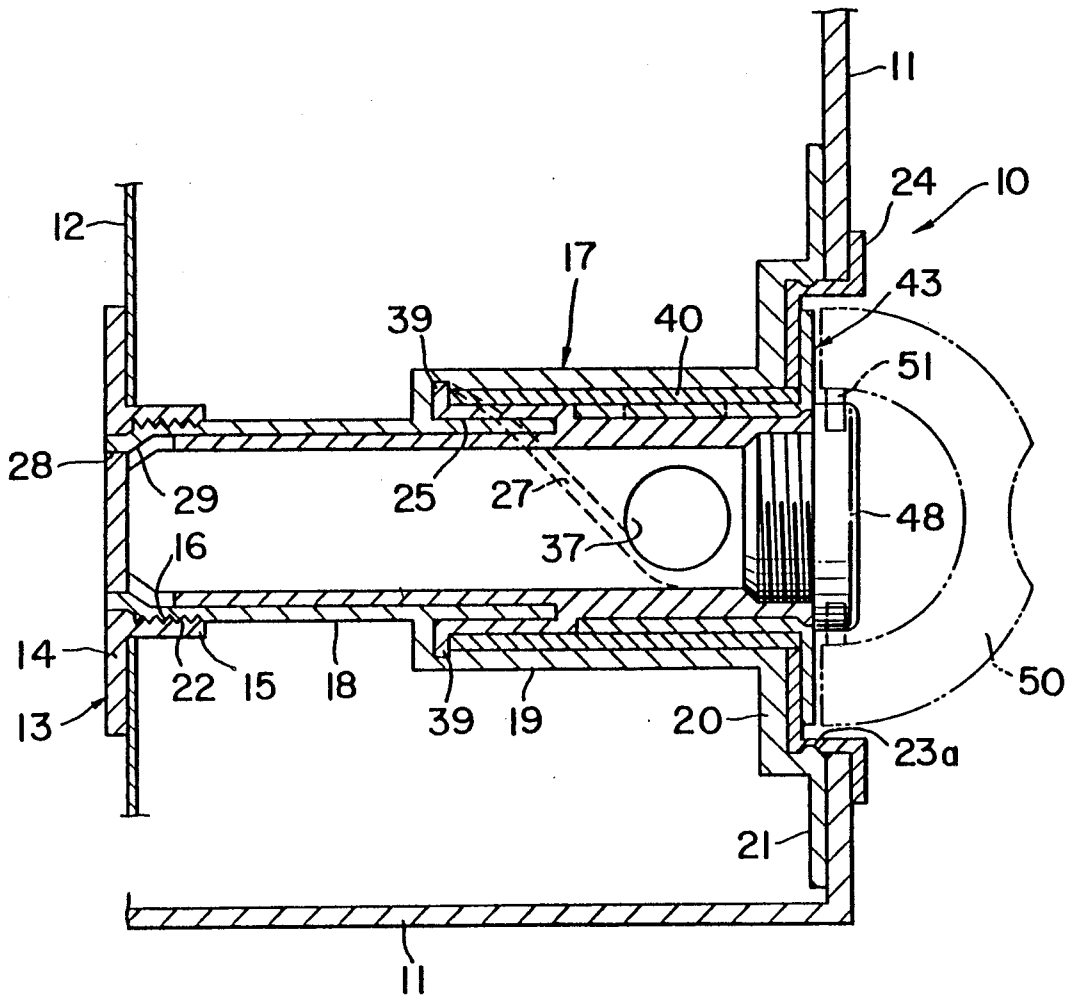
FIG. 1 is a vertical axial section of a tap according to the present invention, with the valve member placed in a retracted position.

In the drawings, like reference characters designate corresponding parts throughout views and descriptions of corresponding parts are omitted after once given.

Figure 2:
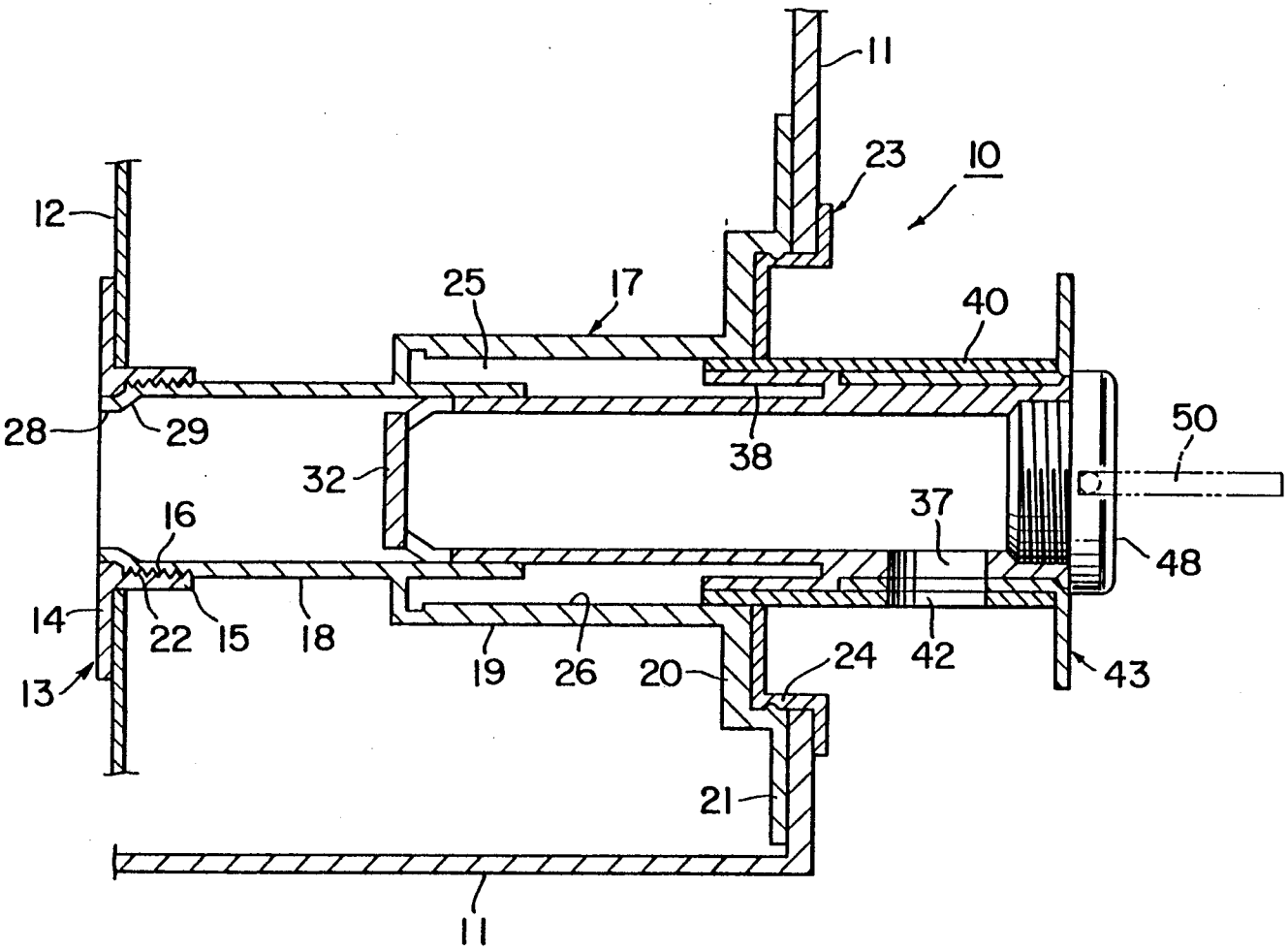
FIG. 2 is a vertical axial section of the tap in FIG. 1 with the valve member placed in an extended position.
Figure 3:
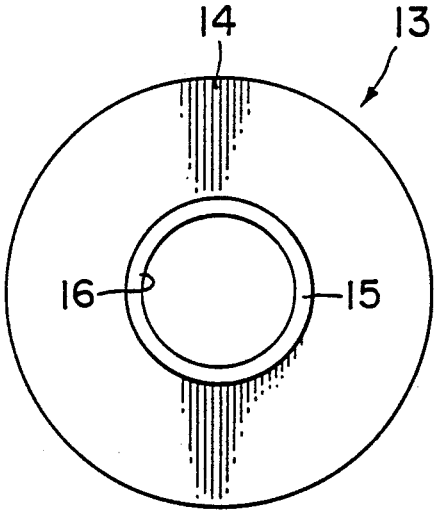
FIG. 3 is a front view of the attachment ring of FIG. 1 on a reduced scale.
Figure 4:
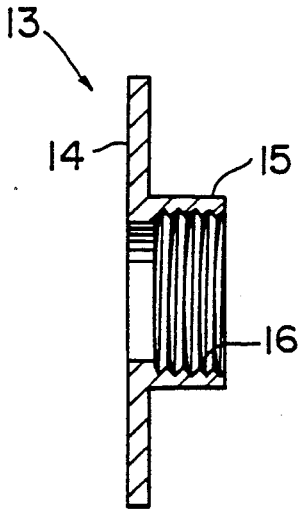
FIG. 4 is an axial cross-sectional view of the attachment ring of FIG. 3.
Figure 5:
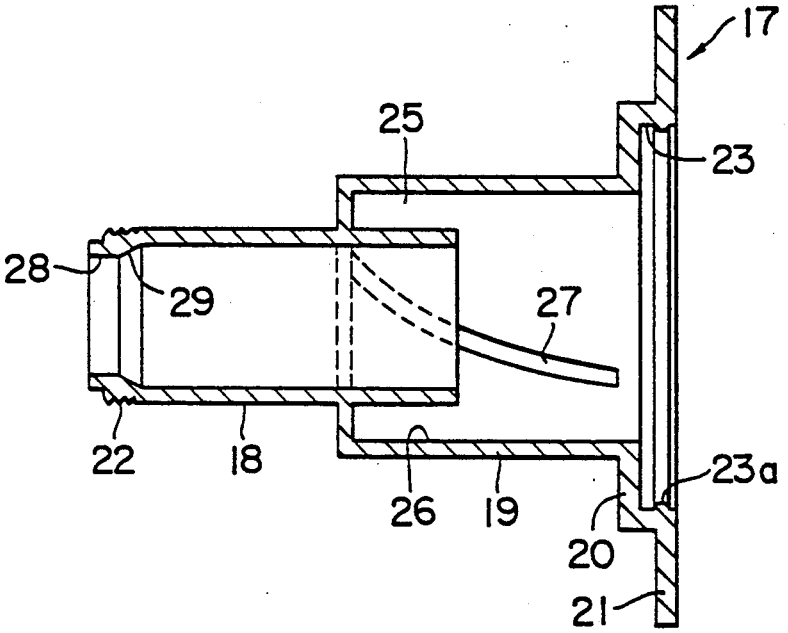
FIG. 5 is a vertical axial section, on a reduced scale, of the valve housing in FIG. 1.
Figure 6:
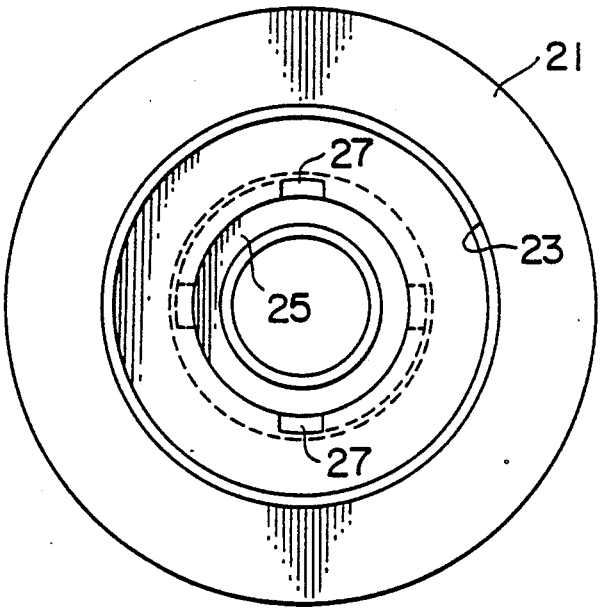
FIG. 6 is a front view of the valve housing in FIG. 5.
Figure 7:
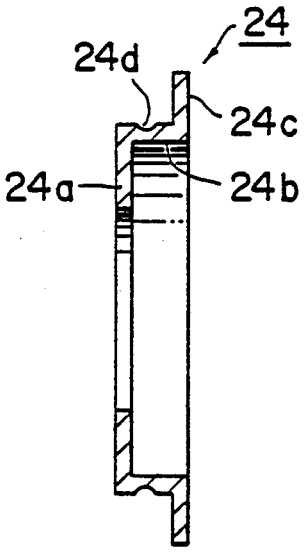
FIG. 7 is an axial cross-sectional view, on a reduced scale, of the retaining ring in FIG. 1.
Figure 8:
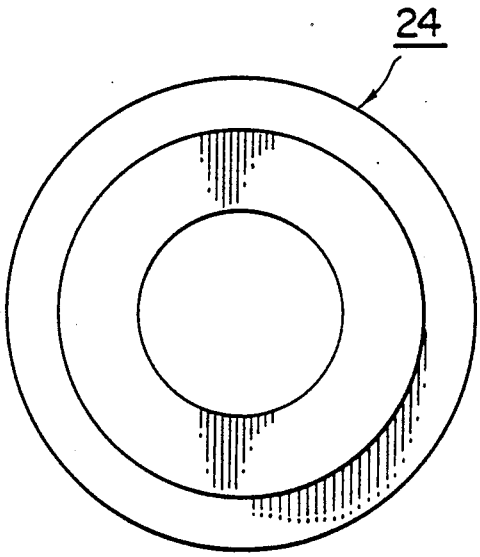
FIG. 8 is a front view of the retaining ring in FIG. 7.

A tap according to the present invention is illustrated in FIG. 1, in which reference numeral 10 designates a tap, which is mounted to a carton 11 made of a cardboard, corrugated board, a synthetic resin board, a metallic sheet or the like material. Within the carton 11, there is accommodated an air-impermeable bag 12, made of a flexible film, for containing a liquid to be dispensed through the tap 10. The carton 11 and the bag 12 are partly shown in FIGS. 1 and 2 for illustration purpose. The bag 12 is placed in the carton 11 with its opening portion 12*a* at a lower position near the bottom of the carton 11 as shown. The opening portion 12*a* of the bag 12 is welded to an attachment ring 13 during manufacturing of the bag. As shown in FIGS. 3 and 4, the attachment ring 13 has a sleeve 14 and an attachment flange 15 projecting radially outwardly from one end of the sleeve 14, the attachment flange 15 being attached to the opening 12*a* of the bag 12. The attachment flange 15 has an threaded inner face 16. The tap 10 has a valve housing 17, which includes, as illustrated in FIGS. 5 and 6, a housing sleeve 18, a housing body 19 mounted at its rear end to the front end portion of the housing sleeve 18, an outer flange 20 and an intermediate flange 21 connecting the outer flange 20 to the front end of the housing body 19, the parts 18, 19, 20, 21 being integrally and coaxially formed. The housing sleeve 18 has a external thread 18*a* formed in the outer face of the rear end thereof and the external thread 18*a* is engaged with the threaded inner face 16 of the attachment ring 13. The outer flange 20 and the intermediate flange 21 define an annular recess 22, of which inner circumferential wall 23 has an annular lip 23*a* formed on it. Snap engaged into the recess 22 is a generally cylindrical cap-shaped retaining ring 24, which, as shown in FIGS. 7 and 8, has an annular end wall 24*a*, an annular side wall 24*b*, and an annular flange 24*c*, the parts 24*a*–24*c* being formed coaxially and integrally. The annular side wall 24*b* has a annular snap groovee 24*d* formed in the outer circumferential face thereof, the wall of the annular snap groove 24*d* being snap engaged with the annular lip 23*a* of the valve housing 17.

The housing body 19 of the valve housing 17 is attached at its rear end to the housing sleeve 18 at an intermediate portion thereof so that it externally surrounds a front part 18*b* of the housing sleeve 18 in a concentric manner to thereby define annular cavity 25 in cooperation with the front part 18*b* of the housing sleeve 18. The housing body 19 is provided in its inner face 26 with a pair of helical grooves 27 angularly and extending axially at a predetermined lead angle and substantially through the overall length of the housing body 19. The housing sleeve 18 has a valve seat 28*a*, defining an inlet port 28, at its rear end and an annular inclined surface 29 formed inside the valve seat 28*a* to be continuous to the latter. The inner wall of the housing sleeve 18 defines a housing passage 18*c*.

Figure 9:
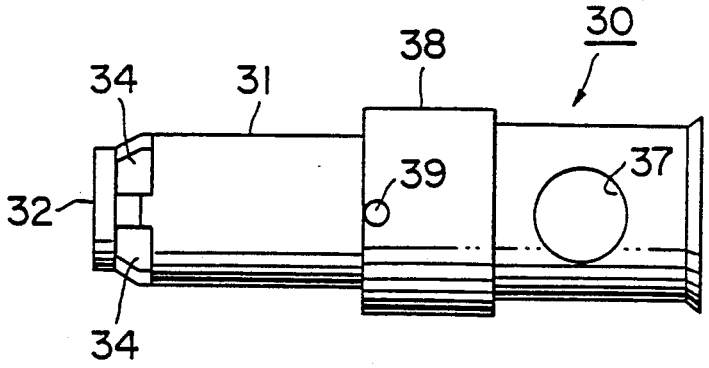
FIG. 9 is a side view, on a reduced scale, of the valve member in FIG. 1.
Figure 10:
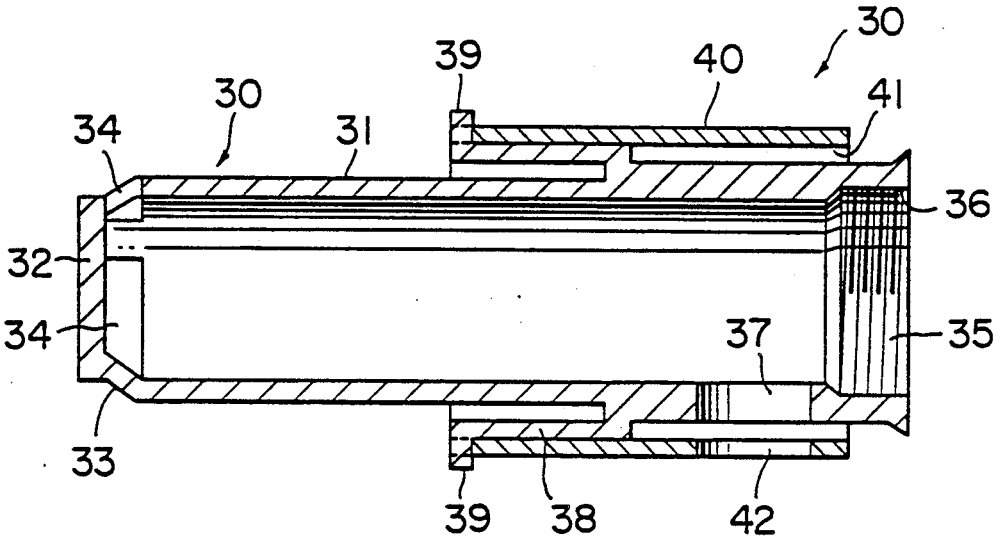
FIG. 10 is an axial cross-sectional view, on a magnified scale, of the valve member in FIG. 9 with the outer sleeve.
Figure 11:
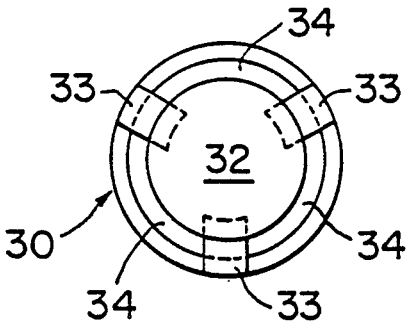
FIG. 11 is a rear view of the valve member in FIG. 10.

A hollow cylindrical valve member 30, as illustrated in FIGS. 9 to 11, is associated with the valve housing 17 for helical movement within the latter. The valve member 30 has a valve tube 31 snugly fit into the housing sleeve 18. The valve tube 31 has a rear end wall 32 closing the rear end thereof and a plurality of, three in this embodiment, ribs 33 connecting the periphery of the end wall 32 to the rear end of the valve tube, whereby adjacent ribs 33, the end wall 32 and the rear end of the valve tube 31 define three first valve apertures 34 at equal angular intervals. The ribs 33 are formed so that the outer faces thereof may rest on inclined surface 29. The valve member 30 has an open front end 35 of which inner face is threaded to form an inner thread 36. Near the open front end 35 there is formed a circular second valve aperture 37 through the wall of the valve member 30. A thin hollow cylindrical skirt 38 is coaxially mounted to an intermediate portion of the valve tube 31 for surrounding the latter from the outside to thereby define a annular cavity 39 in cooperation with the intermediate portion. The skirt 38 is formed to fit into the annular cavity 25 of the valve housing 17. The skirt 38 has a pair of engaging pins 38*a* and 38*a* formed at its rear end symmetrically about the axis X thereof so that they slidably engage with respective helical grooves 27, 27 of the housing body 19.

Figure 12:
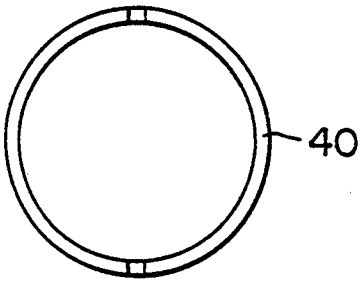
FIG. 12 is a front view, on a reduced scale, of the outer sleeve in FIG. 1.
Figure 13:
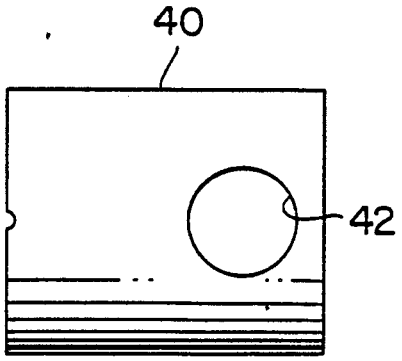
FIG. 13 is a side view of the outer sleeve in FIG. 12.
Figure 14:
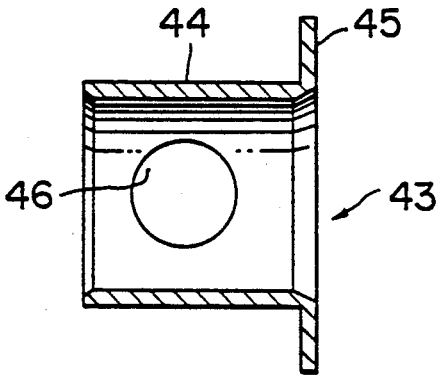
FIG. 14 is a vertical axial section, on a reduced scale, of the dispensing ring in FIG. 1.

The skirt 38 has a hollow cylindrical outer sleeve 40 fitted around it. The outer sleeve 40 extends axially to the front end 35 of the valve tube 31 to define an annular cavity 41 in cooperation with the front portion 31*a* of the valve tube 31. The outer sleeve 40 has a dispensing aperture 42 formed through it to be aligned with the second valve aperture 37. (see also FIGS. 12 and 13) The outer sleeve 40 may be integrally formed with the skirt 38.

Figure 15:
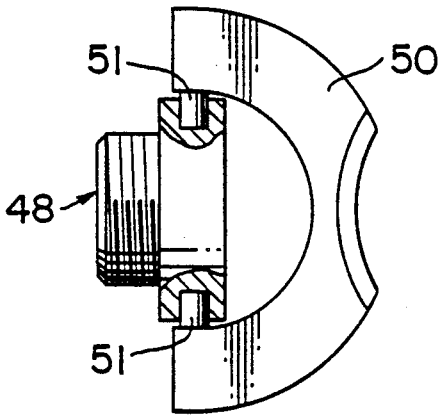
FIG. 15 is a side view, partly in section, of the plug in FIG. 1 on a reduced scale.

Slidably fitted into the annular cavity 41 is a dispensing ring member 43, which includes a dispensing ring 44, fitted around the front portion 31*a* of the valve tube 31, and a flange 45 projecting radially outwardly from the front end of the dispensing ring 44. The dispensing ring 44 has an dispensing aperture 46 formed through it. The dispensing ring member 43 is placed over the front portion 31*a* to align the dispensing aperture 46 with both the second valve aperture 37 and dispensing aperture 42 for flowing liquid outside through it. Threadedly engaged with the inner thread 36 of the valve tube 31 is a plug 48, shown in FIG. 15. The plug 48 normally closes the open front end 35 of the valve tube 31 but is removed when a liquid is to be filled in the bag 12. The plug 48 has a handle 50 pivotally mounted to the head 49 thereof by means of a pair of pivots 51, 51.

In use of the tap 10 for dispensing the liquid, the handle 50 is pulled forwards while it is allowed to rotate about the axis X, so that the engaging pins 38*a*, 38*a* slide within the helical grooves 27, 27. This results in that the front portion of the valve member 30 projects forwards from the valve housing 17 as shown in FIG. 2, in which the inlet port 28 is opened to flow the liquid of the bag 12 into the valve member 30 through the first valve aperture 34. Then, the dispensing ring member 43 is turned about the axis X to align the dispensing valve aperture 46 with both the second valve aperture 37 and the dispensing aperture 42 for allowing the liquid within the valve member 30 to flow outside.

After dispensing a desired amount of the liquid, the dispensing ring member 43 is turned to move the dispensing aperture 46 upwards for closing the second valve aperture 37. The valve member 30 is then pushed backwards to the retracted position shown in FIG. 1 while allowed to rotate.

To fill the bag 12 with a liquid, the valve member 30 is placed in the extended position shown in FIG. 2, in which the plug 48 is removed. Then, a liquid charging nozzle, not shown, is inserted through the open front end 35 into the valve tube 31 to fill the liquid into the bag 12 through the valve passage 31*b*, the housing passage 18*c* and inlet port 28. After filling of the liquid, the open front end 35 is closed again with the plug 48 and the valve member 30 is pushed within the valve housing 17 to the retracted position in FIG. 1.

In this embodiment, the valve member 30 is accommodated within the valve housing 17 with its front end substantially flush with the outer face of the carton 11 when it is in the retracted position, and hence dusts and bacteria are effectively prevented from adhering to exposed surfaces of the valve member 30. The tap 10 is hence capable of keeping it clean. The closed bag 12 communicates to the valve passage 31*b* with a relatively short stroke of the valve member 30. In addtion, the axial length of the tap 10 is considerably reduced sinece the skirt 38 is inserted into the annular cavity 25 of the valve housing 17. Thus, the tap 10 can be made fairly compact.

Figure 16:
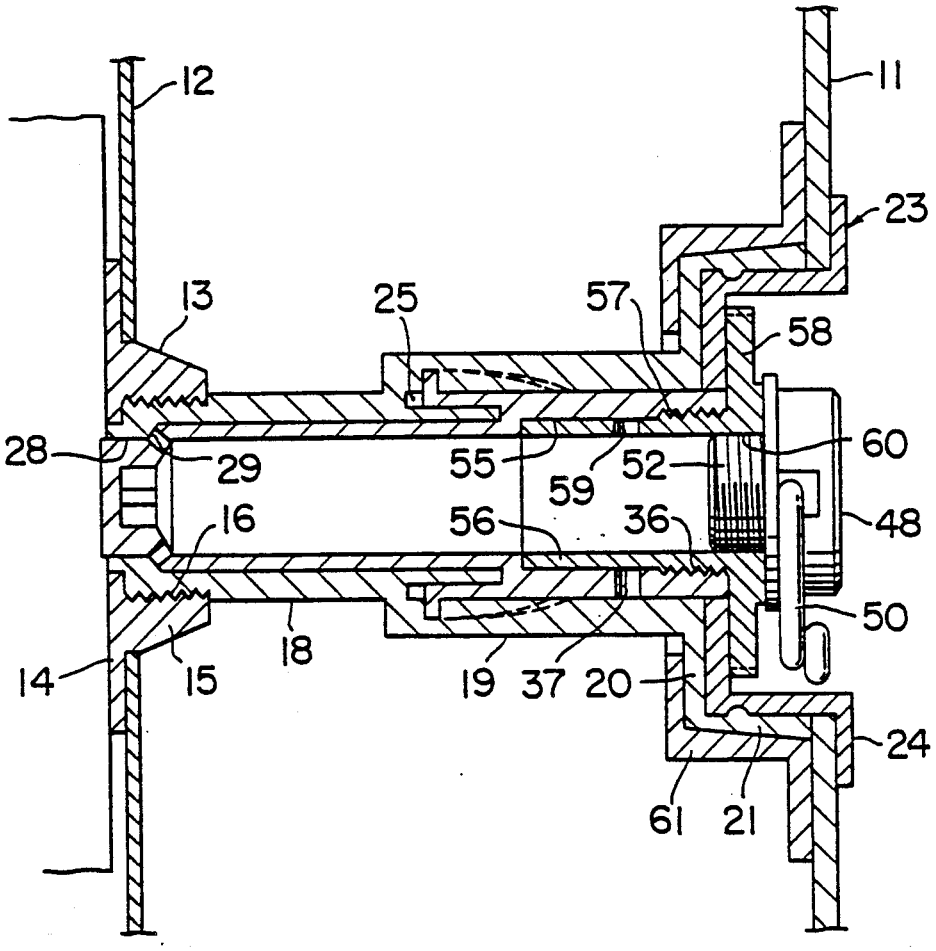
FIG. 16 is a vertical axial section of a second embodiment of the present invention, in which the valve member is placed in a retracted position.
Figure 17:
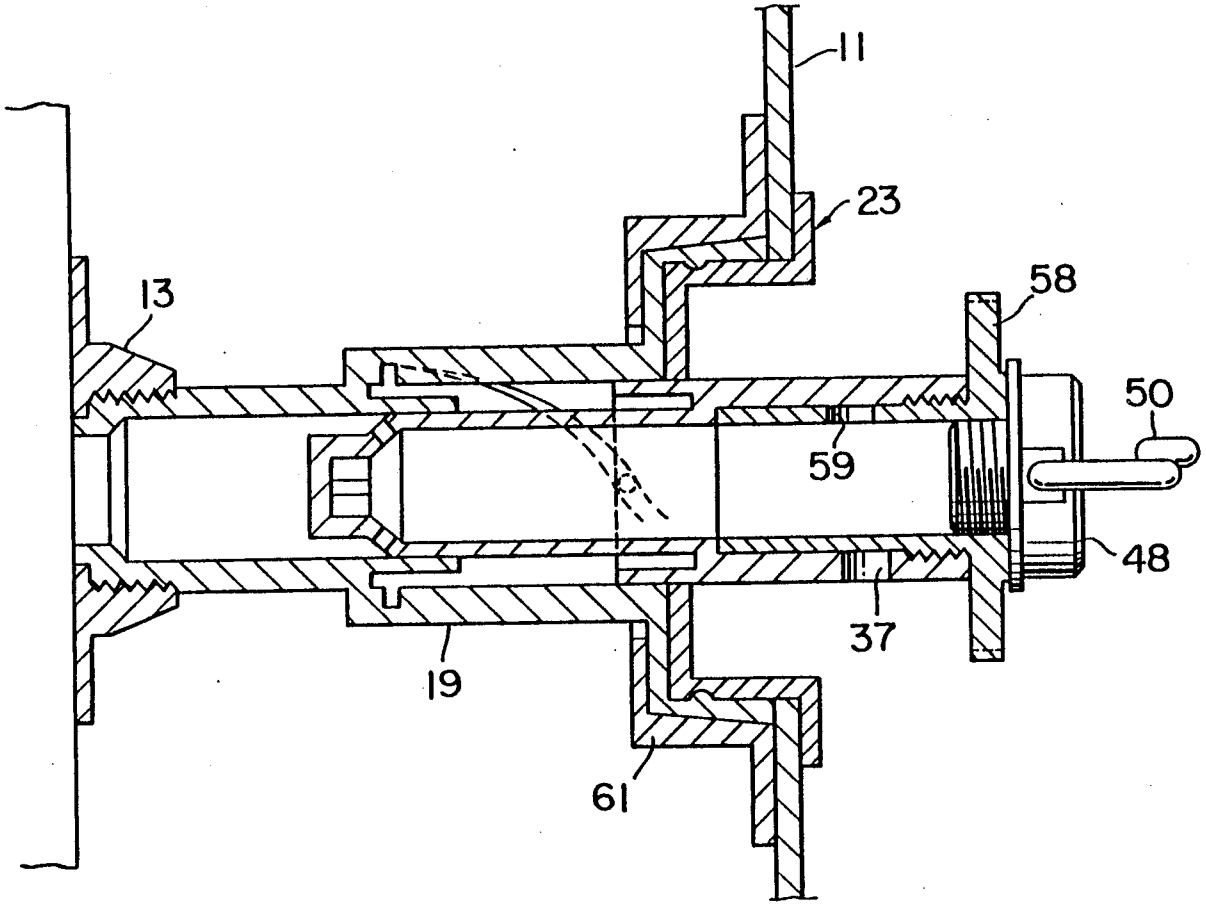
FIG. 17 is a vertical axial section of the tap in FIG. 16, with the valve member placed in an extended portion.
Figure 18:
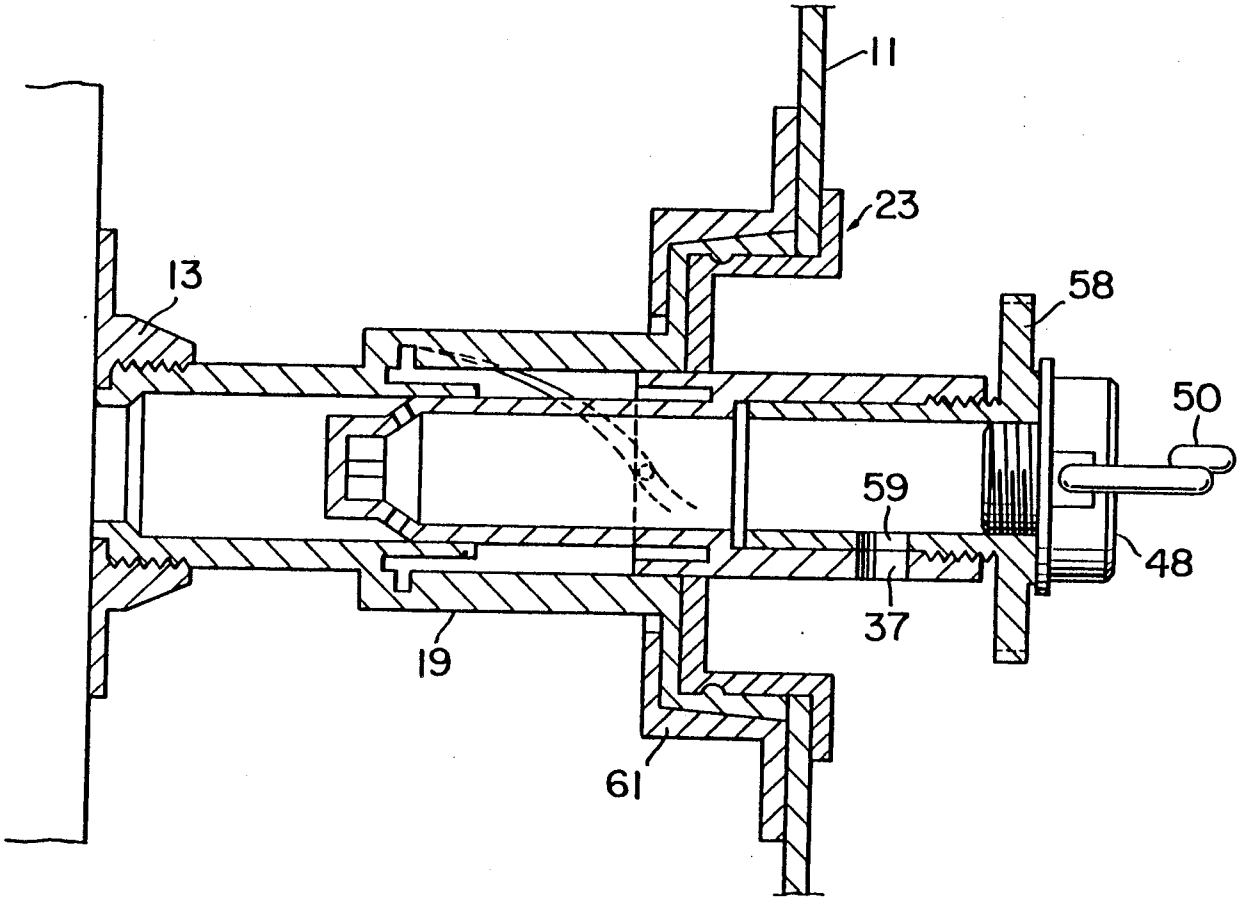
FIG. 18 is a vertical axial section of the tap in FIG. 17, with the dispensing ring placed in an open position.

Referring to FIGS. 16 to 18, a second embodiment of the present invention will be described, in which a dispensing ring 53 is fitted into the valve member 30 and the outer sleeve 40 is omitted. The front portion 31*a* of the valve tube 31 has a diameter enlarged inner wall 55, of which front end is provided with an inner thread 36. The dispensing ring member 53 has a dispensing ring 56, fitted into the enlarged inner wall 55, and a flange 58 formed integrally with the dispensing ring 56 to project radially outwards from the front end of the dispensing ring 56. The dispensing ring 56 is provided in its outer face adjacent to the flange 58 with outer thread 57 which engages with the inner thread 36 of the valve tube 31. The dispensing ring 56 further has a dispensing aperture 59 formed through its intermediate portion. The inner wall of the front end of the dispensing ring 56 is provided with an internal thread 60, with which a threaded portion 52 of a plug 48 engages. In this embodiment, the valve housing 17 is secured to the carton 11 in a manner slightly different from the manner in the preceding embodiment in that the outer flange 21 which axially extends is supported in a cantilever fashion by retaining rings 24 and 61 which sandwich it. A desired quantity of a liquid is dispensed from the bag 12 in manner similar to the manner of the preceding embodiment; that is, the valve member 30 is pulled to project externally of the valve housing 17 as shown in FIG. 17 and then the dispensing ring member 53 is turned relative to the inner wall 55 of the front portion 31*a* of the valve member 31 to align the dispensing aperture 59 with the second valve aperture 37 for allowing the liquid to flow outside through the dispensing aperture 59 and the second valve aperture 37 as illustrated in FIG. 18.

Figure 19:
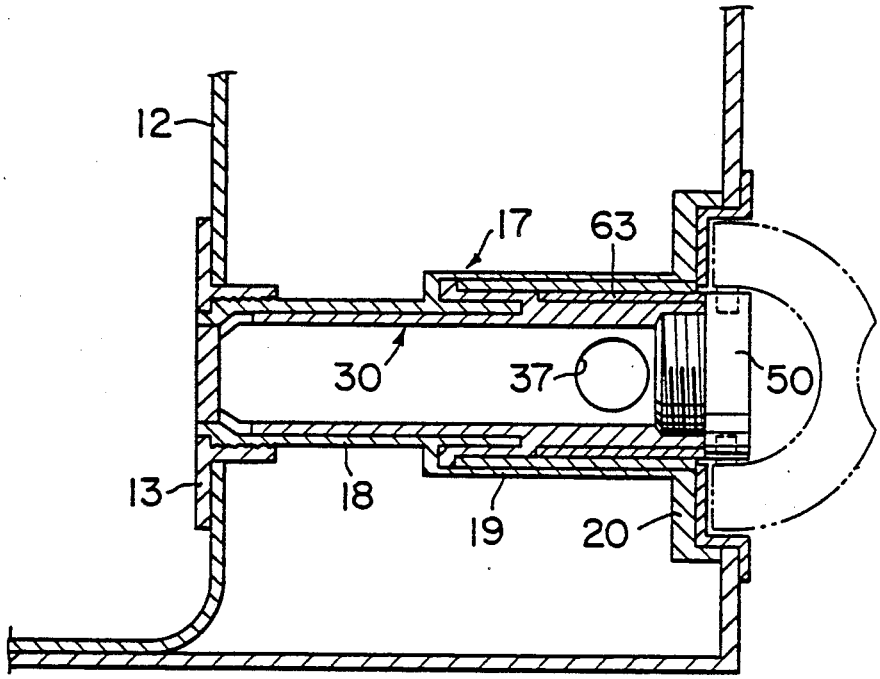
FIG. 19 is a sectioned side elevation of a third embodiment of the present invention, in which the valve member is located in a retracted position.
Figure 20:
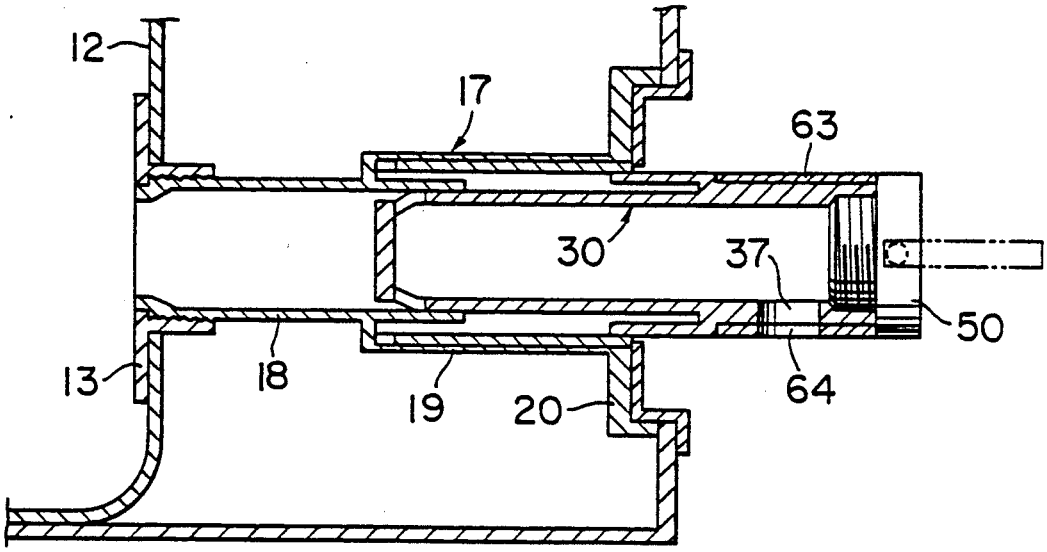
FIG. 20 is a sectioned side elevation of the tap in FIG. 19, with the valve member located in an extended position, with the dispensing ring opened.

A third embodiment of the present invention is shown in FIGS. 19 and 20, in which a dispensing ring member 63 is rotatably fitted around the front portion 31*a* of the valve tube 31. The dispensing ring member 63 has a dispensing aperture 64 formed through it and is rotated about the axis to align the dispensing aperture 64 with the second valve aperture 37 for allowing the liquid within the valve tube 31 to flow outside. Also in this embodiment, the plug 48 is threaded to the inner wall of the front end of the valve member 30 but as shown in FIGS. 19 and 20, the head 50*a* thereof is brought into abutment against the front end of the dispensing ring member 63 for holding the the ring member 63 from axial movement. To supply a desired quantity of the liquid from the bag 12, substantially the same procedure as in the preceding embodiment is carried out; that is, the valve member 30 is pulled to project the front portion 31*a* outside from the valve housing 17, and then the dispensing ring member 63 is rotated to align the dispensing aperture 64 to the second valve aperture 37 as illustrated in FIG. 20. This procedure is then reversed in order to close the tap.

What is claimed is:

1. In a liquid dispenser of the type which includes a carton, a flexible bag, having an aperture and received within the carton with the aperture at a lower portion, the bag containing a predetermined amount of a liquid, and a tap communicated at one end to the aperture of the bag, the tap supported at the other end on the carton for dispensing the liquid outside the carton, the improvement wherein the tap comprises:

a valve housing including one end having an inlet port formed therethrough for introducing a liquid thereinto, a circumferential wall defining a housing passage axially extending therein to communicate with the inlet port, and an attachment flange mounted to the other end thereof for attachment to the carton;

a tubular valve member telescopically received in the housing passage for axial movement, the valve member including one end portion having a first valve aperture formed therein, a circumferential wall having a second valve aperture formed therethrough and defining a valve passage communicating the second valve aperture to the first valve aperture for entering the liquid from the housing passage and through the first valve aperture therein, and a closed other end portion; and dispensing means, movably attached to the valve member, for dispensing the liquid from the valve passage, the dispensing means being movable between an opening position to open the second valve aperture for allowing the liquid to flow outside through the second valve aperture and a closed position to close the second valve aperture wherein the valve housing comprises: a hollow cylindrical housing sleeve, including the inlet port at one end thereof and an outer circumferential face; and a hollow cylindrical housing body concentrically mounted at one end thereof to the outer circumferential face of the housing sleeve to externally surround a part of the housing sleeve to define an annular cavity in cooperation with the housing sleeve, the housing body having the other end remote from the one end of the housing sleeve, the housing body including an inner circumferential face having at least one helical groove formed therein to extend axially and angularly about the valve passage;

wherein the valve member is axially movable between a retracted position to be substantially contained within the valve housing and an extended position to project outwardly of the other end of the valve housing, and wherein the valve member comprises a skirt integrally formed therewith so that the skirt is inserted in the annular cavity when the valve member is in the retracted position, the skirt including an engaging pin engaged within the helical groove; and wherein the attachment flange of the valve housing is mounted to the other end of the housing body for supporting the valve housing on the carton.

2. A liquid dispenser as recited in claim 1, wherein: the circumferential wall of the valve member comprises an inner circumferential face and an outer circumferential face; the dispensing means comprises a dispensing ring member fitted on one of both the inner circumferential face and the outer circumferential face for angular movement about the axis of the valve member; and the dispensing ring member has a dispensing aperture formed therethrough so that the dispensing aperture thereof is aligned with the second valve aperture in the open position of the dispensing ring member while the dispensing aperture thereof is out of alignment with the second valve aperture in the closed position.

3. A tap comprising:

a valve housing including one end having an inlet port formed therethrough for introducing a liquid thereinto, a circumferential wall defining a housing passage axially extending therein to communicate with the inlet port, and an attachment flange mounted to the other end thereof for attachment to a supporting member, said circumferential wall of the valve housing including an inner circumferential surface having at least one helical groove formed therein to extend axially and angularly about the housing passage;

a tubular valve member telescopically received in the housing passage for axial movement, the valve member including one end portion having a rear end wall closing the rear end thereof and a first valve aperture formed therein, a circumferential wall having a second valve aperture formed therethrough and defining a valve passage communicating the second valve aperture to the first valve aperture for entering the liquid from the housing passage and through the first valve aperture thereinto, a closed other end portion; and an engaging pin engaged within the at least one helical groove so that the axial movement of the valve member causes angular movement thereof about an axis thereof; and dispensing means, movable fitted to the valve member for angular movement about the axis of the valve member and, for dispensing the liquid externally of the valve passage, the dispensing means being movable between an opening position to open the second valve aperture for allowing the liquid to flow outside through the second valve aperture and a closed position to close the second valve aperture.

4. A tap as recited in claim 3, wherein the valve housing comprises: a hollow cylindrical housing sleeve, including the inlet port at one end thereof and an outer circumferential face; and a hollow cylindrical housing body concentrically mounted at one end thereof to the outer circumferential face of the housing sleeve to externally surround a part of the housing sleeve to define an annular cavity in cooperation with the housing sleeve, the housing body having the other end remote from the one end of the housing sleeve and nearer to the other end thereof, the housing body including an inner circumferential face having at least one helical groove formed therein to extend axially and angularly about the housing passage, wherein the valve member is axially movable between a retracted position to be substantially contained within the valve housing and an extended position to project outwardly of the other end of the valve housing, and wherein the valve member comprises a skirt integrally formed therewith so that the skirt is inserted in the annular cavity when the valve member is in the retracted position, the skirt including an engaging pin engaged within the helical groove.

5. A tap as recited in claim 3, wherein the one end of the valve housing comprises a valve seat defining the inlet port, and wherein the one end portion of the valve member includes one end wall having a valve sealing face formed thereon for resting on the valve seat to close the inlet port of the valve housing.

6. A tap as recited in claim 3, wherein the valve member comprises a plug threaded to the other end portion thereof for closing the other end portion.

7. A tap as recited in claim 3, wherein the dispensing ring member is fitted around the valve member for the angular movement, the dispensing ring member having a dispensing aperture formed therethrough so that the dispensing aperture of thereof is aligned with the second valve aperture in the open position of the dispensing ring member while the dispensing aperture thereof is out of alignment with the second valve aperture in the closed position.

8. A tap as recited in claim 3, wherein a the dispensing ring member is fitted within a circumferential wall of the valve member for the angular movement, the dispensing ring member has a dispensing aperture formed therethrough so that the dispensing aperture thereof is aligned with the second valve aperture in the open position of the dispensing ring member end the dispensing aperture thereof is out of alignment with the second valve aperture in the closed position.

9. A tap as recited in claim 3, wherein the valve housing comprises a pair of helical grooves formed in the inner circumferential surface symmetrically about the axis of the valve housing.

10. A tap as recited in claim 9, wherein: the valve member comprises a cylindrical outer sleeve mounted to the skirt to externally and coaxially surround the valve member, the outer sleeve extending toward the other end wall of the valve member to define an annular cavity in cooperation with the valve member, the outer sleeve having a dispensing aperture formed therethrough to be aligned with the second valve aperture; the dispensing ring member is fitted around the valve member and in the annular cavity of the valve member; and the dispensing ring member has a dispensing aperture formed therethrough so that the dispensing aperture of the dispensing ring member is aligned with the second valve aperture in the open position of the dispensing ring member while the dispensing aperture of the dispensing ring member is out of alignment with the second valve aperture in the closed position.

11. A tap as recited in claim 10, wherein the attachment flange of the valve housing is mounted to the other end of the housing body for supporting the valve housing on the supporting member.

* * * * *